United States Patent [19]

Bae

[11] Patent Number: 4,934,280

[45] Date of Patent: Jun. 19, 1990

[54] FOLDABLE SINK TABLE

[75] Inventor: Sok- Kyu Bae, Seoul, Rep. of Korea

[73] Assignee: Fine Industrial Co., Inc., Seoul, Rep. of Korea

[21] Appl. No.: 323,759

[22] Filed: Mar. 15, 1989

[30] Foreign Application Priority Data

Apr. 15, 1988 [KR] Rep. of Korea ..... 88-4304[U]

[51] Int. Cl.[5] ..... A47B 57/00

[52] U.S. Cl. ..... 108/99; 108/25; 108/115

[58] Field of Search ..... 108/14, 25, 26, 99, 108/115

[56] References Cited

U.S. PATENT DOCUMENTS

| | | | |
|---|---|---|---|
| 1,346,470 | 7/1920 | Schroeder | 108/25 X |
| 1,656,789 | 1/1928 | Haskin | 108/99 |
| 2,082,380 | 6/1937 | Capra | 108/25 X |
| 2,122,275 | 6/1938 | Bitney | 108/25 X |
| 2,859,082 | 11/1958 | Logue | 108/25 X |
| 2,942,921 | 6/1960 | Rachman et al. | 108/26 |
| 4,437,714 | 3/1984 | Struck | 108/25 |

*Primary Examiner*—Peter A. Aschenbrenner

*Attorney, Agent, or Firm*—Beveridge, DeGrandi & Weilacher

[57] ABSTRACT

A foldable sink table for use in open fields is disclosed. The device comprises an upper cover; a hanging rod and a rubber string installed within the said upper cover for hanging cooking aids; small shelves installed also within the said upper cover for mounting small articles such as small condiment bottles; a cooking table composed of a frame and a plate; a sink basin installed adjacently to the said cooking table; a grill installed under the cooking table and secured to legs, for mounting and drying dishes and bowls; a reinforcing member connected to legs; a range table disposed beside the cooking table; a multi-purpose shelf installed under the range table hinges and links for a pivotal connection between the upper cover and the cooking table; hinges and links for a pivotal connection between the cooking table and the legs; depending rods pivotally secured to the said grill; and depending rods pivotally secured to the range table and to the multi-purpose shelf. The foldable sink table, when fully unfolded, gives a maximum usable area in the form of a cooking table, a sink basin, a range table, a grill, a multi-purpose shelf, and the like, while it is reduced to a minimum volume when folded up, so that it should be convenient to carry with.

22 Claims, 9 Drawing Sheets

1
7b
13
11
9
3
45
15
10
28
27
16
43
28'
43
34'
35
4
29
18
D
44
7a
8a
12a
12
7
7c
14
14'
7b
11
2
2b
11'
11a
11b
44
23
E
5
6
31
30
33
42
39
36
40
35
34
43
43
17
37
41
38
27

FIG. 2( I )
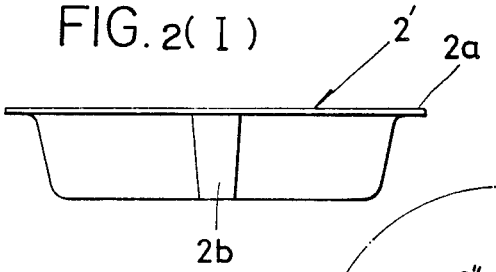
FIG. 2(III)
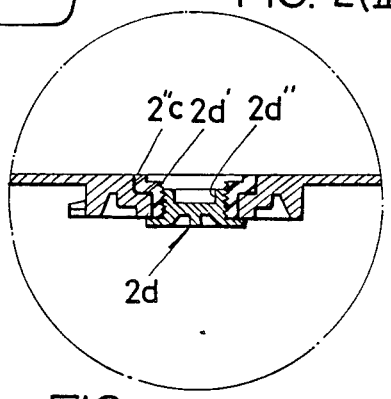
FIG. 2( II )
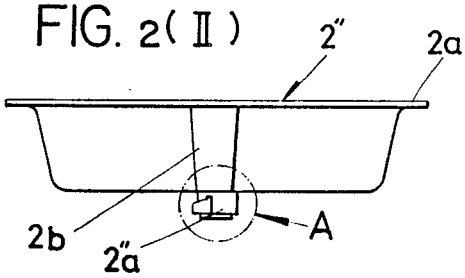
FIG. 2(IV)
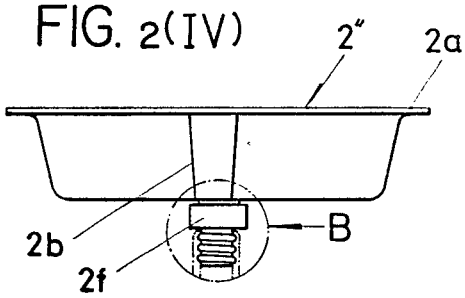
FIG. 2( V )
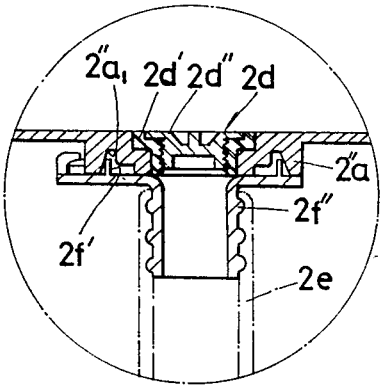
FIG. 2(VI)
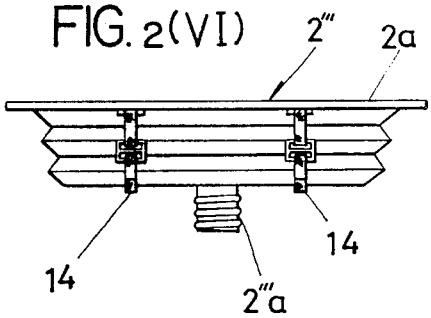

FIG. 7(III)
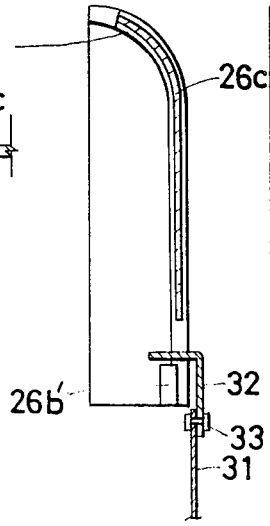

FIG. 9(I)
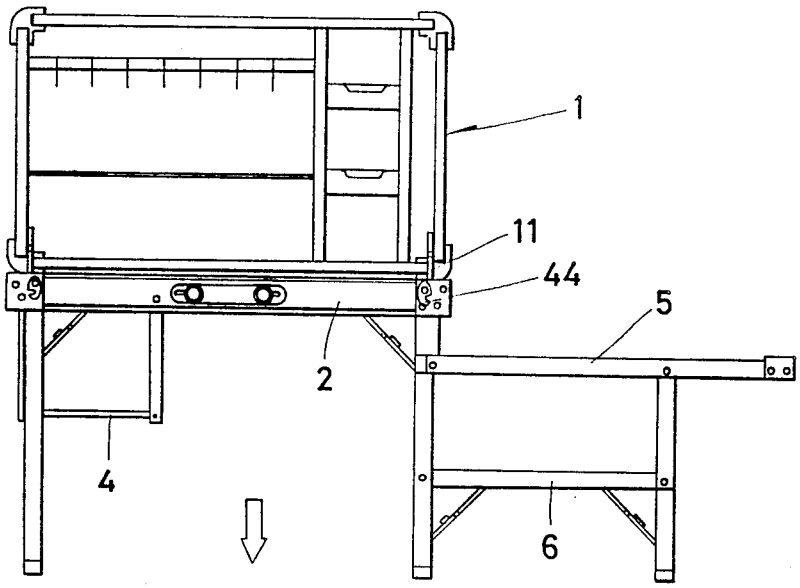
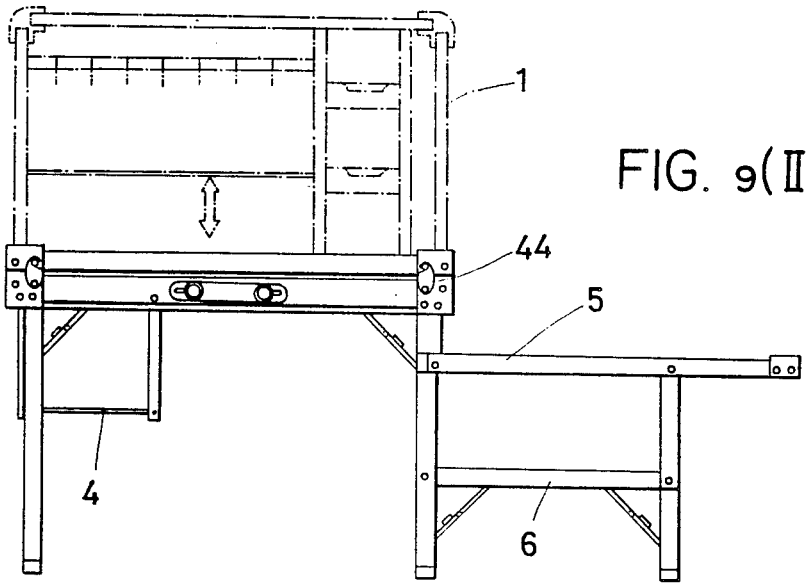
FIG. 9(II)

FIG. 9(III)
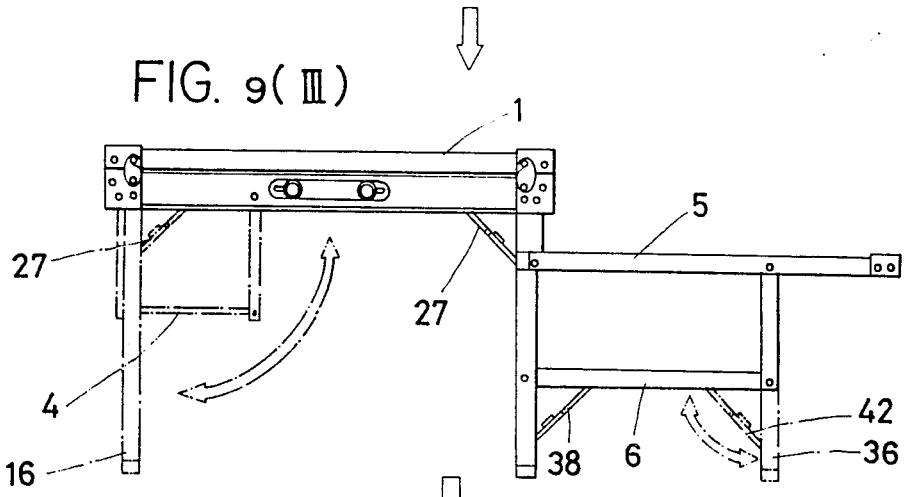

FOLDABLE SINK TABLE

FIELD OF THE INVENTION

The present invention relates to a folding type sink table which is unfoldable in an easy manner in open fields or mountains, and quickly foldable in order to conveniently carry it.

BACKGROUND OF THE INVENTION

Conventionally there were seen some leisure articles for fishing and mountain climbing such as tents, knapsacks, tables, chairs, etc. which are the general leisure articles, and also burners, knives, etc. which are the cooking aids. But it has been inconceivable to carry a sink table in going on a picnic, and therefore, a burner or a cooking table was used inconveniently without a sink table in an open field. Although such a burner and cooking table formed a simplified table, it was very inconvenient, and in some cases, a sink table had to be acquired at the site, thereby making the picnickers feel a severe inconvenience.

SUMMARY OF THE INVENTION

The device of the present invention is intended to overcome the inconveniences of the conventional practices, and the following are the objects of the present invention.

It is the primary object of the present invention to provide a foldable sink table which gives a maximum usable area when unfolded, and which occupies a minimum volume, so that it may be usable for multiple purposes when unfolded, and may be conveniently carried when folded up.

It is another object of the present invention to provide a foldable sink table which is made of a material having a superior strength and a light weight such as aluminum, plastic, wood, and the like, and which is designed with emphasis on the links of the total constitution, so that the foldable sink table should be durable, light in weight, and convenient to carry with, being unfoldable to use and foldable to carry with.

In order to achieve the above objects, the present invention has a constitution such that a hanging rod for hanging cooking tools and small shelves for mounting condiment bottles and spice bottles are provided on the inside of the upper cover of the sink table; the cooking table is composed of a frame and plate; a sink basin is provided on one side of the cooking table; a grill for mounting dishes and bowls is installed adjacent to the table legs of one side of the table and under the cooking table; a reinforcing member is provided adjacent to the legs of the other side of the table and under the cooking table; and a range table and a multipurpose shelf are provided beside the cooking table, all the above mentioned components being foldably/unfoldably assembled by means of a combination of hinge pins and link structures.

BRIEF DESCRIPTION OF THE DRAWINGS

The above objects and other advantages of the present invention will become more apparent by describing the preferred embodiment of the present invention with reference to the attached drawings in which:

FIGS. 2 (I–VI) illustrate the sink basin of the present invention, in which:

FIG. 2 (I) shows the first embodiment of the sink basin,

FIG. 2 (II) shows the second embodiment of the sink basin,

FIG. 2 (III) shows an enlarged cross sectional view for the portion A of FIG. 2 (II), FIG. 2 (IV) shows a state in which a hose connector is attached, FIG. 2 (V) is an enlarged cross sectional view of the portion B of FIG. 2 (IV), and FIG. 2 (VI) shows the third embodiment of the present invention;

FIGS. 4 (I) and (II) show cross sectional views taken along the line C—C of FIG. 3, in which:

FIG. 4 (I) shows a state in which the handle is not used,

FIG. 4 (II) shows a state in which the handle is being used;

FIGS. 7 (I–IV) show the reinforcing member installed in the device of the present invention, in which:

FIG. 7 (I) is an exploded perspective view of the reinforcing member,

FIG. 7 (II) is a cross sectional view of the critical part, showing its assembling process, FIG. 7 (III) shows a state of it when the range table is folded up, and FIG. 7 (IV) shows a state of it when the range table is unfolded out;

DETAILED DESCRIPTION OF THE INVENTION

Figures 1, 1A, 1B:
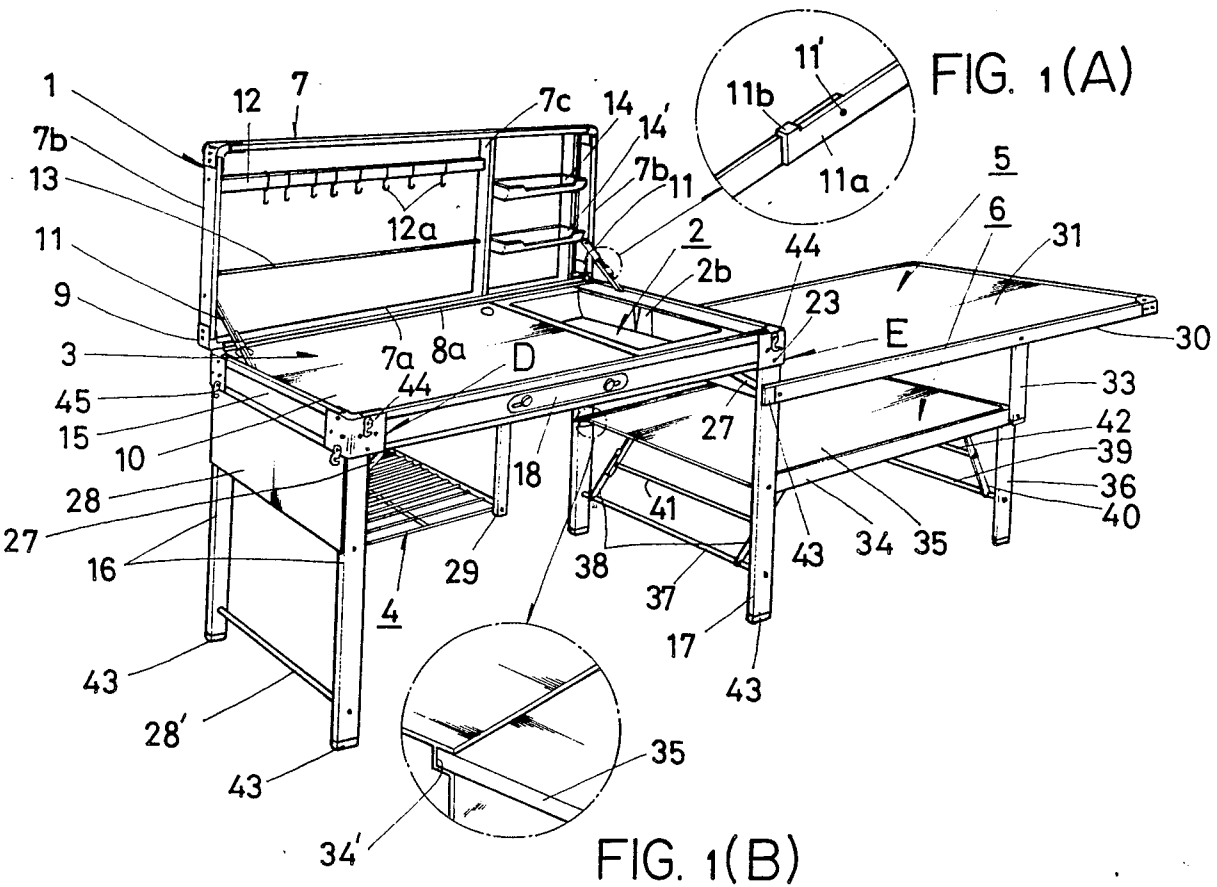
FIG. 1 is a perspective view of the foldable sink table according to the present invention.
FIGS. 1(A) and 1(B) show enlarged views of certain features of FIG. 1.

Referring to FIG. 1 in which the foldable sink table according to the present invention is illustrated, the foldable sink table comprises an upper cover 1, a cooking table 3 with a sink basin 2 integrally formed at one side thereof, a grill 4 installed under the cooking table 3 and toward one side thereof, a range table 5 disposed at the right hand side of the cooking table 3 and a multipurpose shelf 6 installed under the range table 5.

The upper cover 1 is openable/closable due to the function of a hinge 9 which is inserted between a rear edge 7*a* of a cover frame 7 and a rear edge of a rear frame 8*a* of the cooking table 3. Between the opposite side frames 7*b* and the two side edges of an upper plate 10 of the cooking table 3, there are installed links 11 respectively which can support and secure the said opposite side frames 7*b* and the said two side edges. The upper cover 1 is provided in the inside thereof with a hanging rod 12 on which a plurality of hooks 12*a* are installed so that various cooking tools could be hung on them, the said hanging rod 12 being installed between an intermediate frame 7*c* and a side frame 7*b*, and under the hanging rod 12, there is installed a rubber string 13 between the same frames. Adjacently to the hanging rod and the rubber string, two small shelves 14,14' are installed vertically separated each other, so that small condiment bottles or spice bottles could be mounted on them. When the foldable sink table is folded up, the said shelves are received into the link basin 2, and this will be described further below.

As shown in the enlarged illustration of FIG. 1(A), the link 11 is provided with a hinge pin 11', and one link piece 11*a* is provided with a projection 11*b* at the end thereof, for making the link 11 maintained in a straight line when the cover 1 is lifted up.

The sink basin 2 is detachably provided on one side of the cooking table 3, and the shape of the sink basin 2 can be variously formed as shown in FIG. 2 (I–VI).

FIG. 2 (I) shows an ordinary type of the basin which can be formed by injection molding or by a power press. This sink basin is indicated by reference No. 2', and the upper circumference of the sink basin is provided with a projected edge 2*a* for mounting on the edge of the open recess formed adJacently to the cooking table 3, while the opposite side walls of the sink basin is provided with sloped recesses 2*b* respectively for facilitating the installation of the sink basin 2.

FIGS. 2 (II) to (V) show a different embodiment of the sink basin, but it is same in that the upper circumference is provided with a projected edge 2*a*, and that the inside of the opposite side walls are respectively provided with a sloped recess 2*b*. But the sink basin 2'' is different from the sink basin 2' in that the former is provided with a drain hole 2''*c* at the center of its bottom so that a closure 2*d* formed by a threadable combination of a rubber cap 2*d'* and a metal cap 2*d''* could be inserted in order to drain off the water in the sink basin. If the sink basin 2'' is to be used with the drain hole 2''*c* closed, the metal cap 2*d''* is threadably combined to the rubber cap 2*d'* from below, as shown in FIG. 2 (III). If the sink basin is to be used with a hose connected, then the metal cap 2*d''* is threadably combined to the rubber cap 2*d'* from above, a separate hose connector 2*f* is fitted to a lower projection 2''*a*, and a hose 2*e* is connected to the hose connector 2*f* as shown in FIGS. 2 (IV) and (V). As the upper tip of the hose connector 2*f* is provided with a projection 2*f'*, this projection 2*f'* is pressingly contacted with the sloped inner face 2''*a*1 of the lower projection 2''*a* of the sink basin 2''. Further as projections 2*f''* are formed around the lower portion of the hose connector 2*f*, the lower portion of the hose connector 2*f* is pressingly secured to the hose 2*e*. Therefore, when the water contained in the sink basin 2'' is to be drained by removing the closure 2*d*, the draining water will not leak, but will drain only through the hose 2*e*.

FIG. 2 (VI) shows still another embodiment of the sink basin 2, which is same as the sink basin 2'' in that the upper circumference is provided with an integral projected edge 2*a*, and the side walls are respectively provided with a sloped recess 2*b*, but which is different from the sink basin 2''' in that this sink basin 2'' is provided with a furrow-folding type wall, and with adjusting belts 14 for adjusting the height of the furrow-folding type wall and for supporting purposes. The adjusting belts 14 are secured to the two opposite positions of the bottom of the open space for accommodation of the sink basin, and a hose connector 2'''*a* is formed integrally with the sink basin 2'''.

Figure 3:
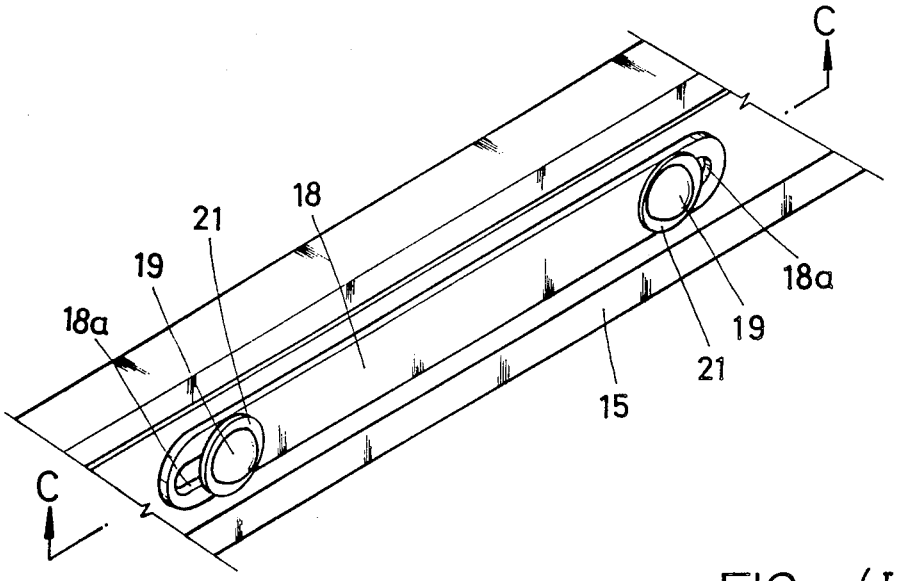
FIG. 3 is a perspective view of the portion of the handle provided on the device of the present invention.

The cooking table 3 is formed by fitting an upper plate 10 with a peripheral frame 15, and legs 16,17 are respectively secured to the frame 15 through hinges. A handle 18 is installed on the front face of the frame 15, and this handle 18 is provided with a pair of slots 18*a* through which bolts 19 pass respectively into the front portion of the frame 15 in order to be secured there by means of nuts 20 and washers 21, as shown in FIGS. 3 and 4.

Figure 4I:
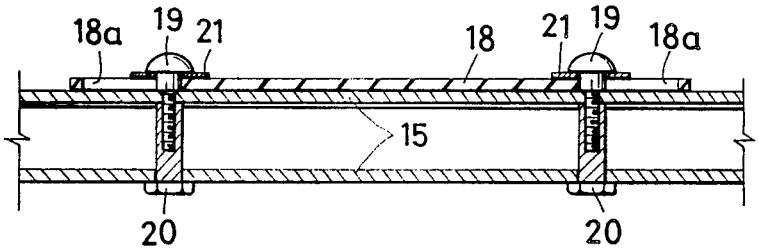
Figure 4:
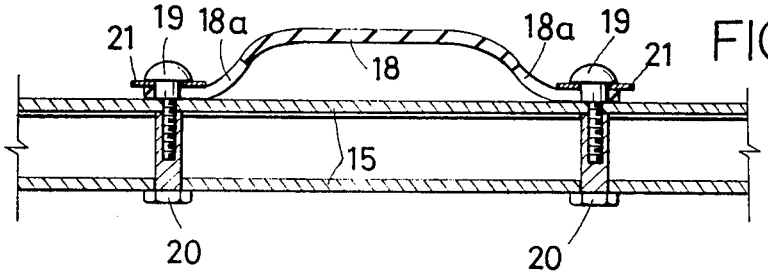

When the handle 18 is not being used, it is contacted to the front face of the frame 15 in a flat shape, while if it is being used, the handle 18 is raised due to the constitution of the slots, as shown in FIGS. 4 (I) and (II), so that the foldable sink table could be carried in the folded-up state.

Figure 5:
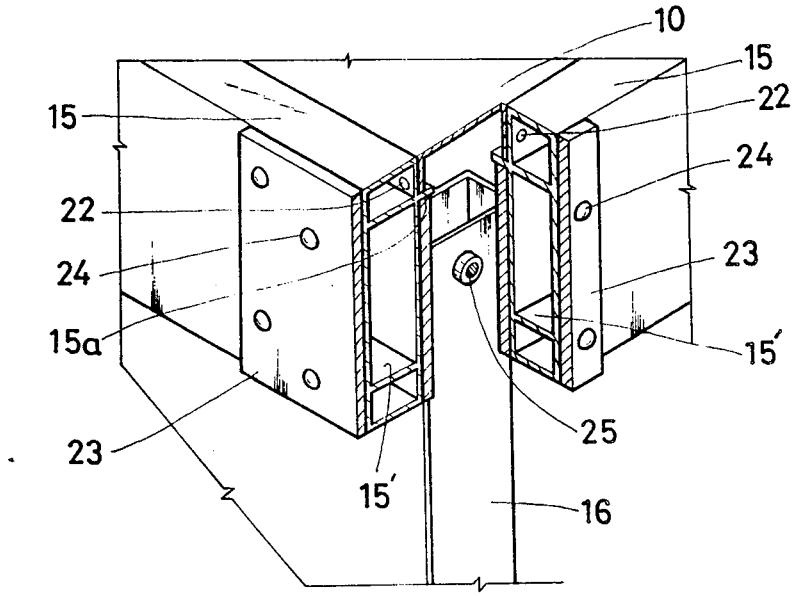
FIG. 5 is a perspective view of the portion D of FIG. 1, in which the portion is partly cut out.
Figure 6:
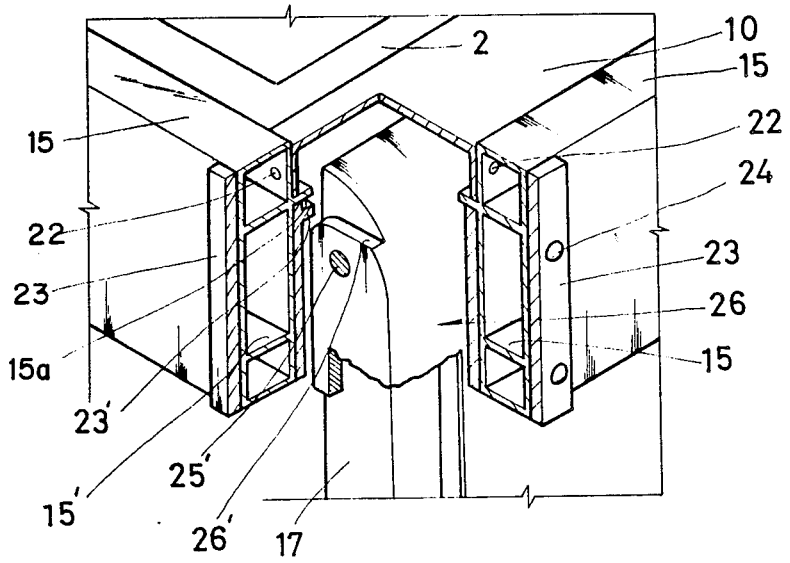
FIG. 6 is a partly cut-out perspective view of the portion E of FIG. 1.

As shown in FIGS. 1, 5 and 6, the frame 15 made of a hollow tube is integrally provided with inner ribs 15', and is also integrally provided with a projected end 15*a* at one side thereof. A plate 10 with its edges rectangularly bent is mounted on the said projected end 15*a*, and is secured by means of rivets 22. When fitting the plate 10 to the frame 15, a holder 23 having long grooves at its tips in a rectangularly oriented relationship is used, so that the frames 15 could be inserted into the grooves and be secured by means of rivets 24.

As shown in FIG. 5, a leg 16 is secured pivotally to the frame 15 through a hinge pin 25, the said leg 16 being located under the left side of the cooking table 3, while, as shown in FIG. 6, a leg 17 together with a reinforcing member 26 is pivotally secured to the frame 15 through a hinge pin 25', this leg 17 being located under the right hand side of the cooking table 3. As to the reinforcing member 26, descriptions will be made further below.

An end step 26' is formed at each end of the reinforcing member 26, and a projected end 23' is integrally provided at one end of the holder 23, so that, when the leg 17 is made to stand uprightly, a contaction should be formed between the said end step 26' and the said projected end 23', thereby making the load born through the contact faces.

Figure 7I:
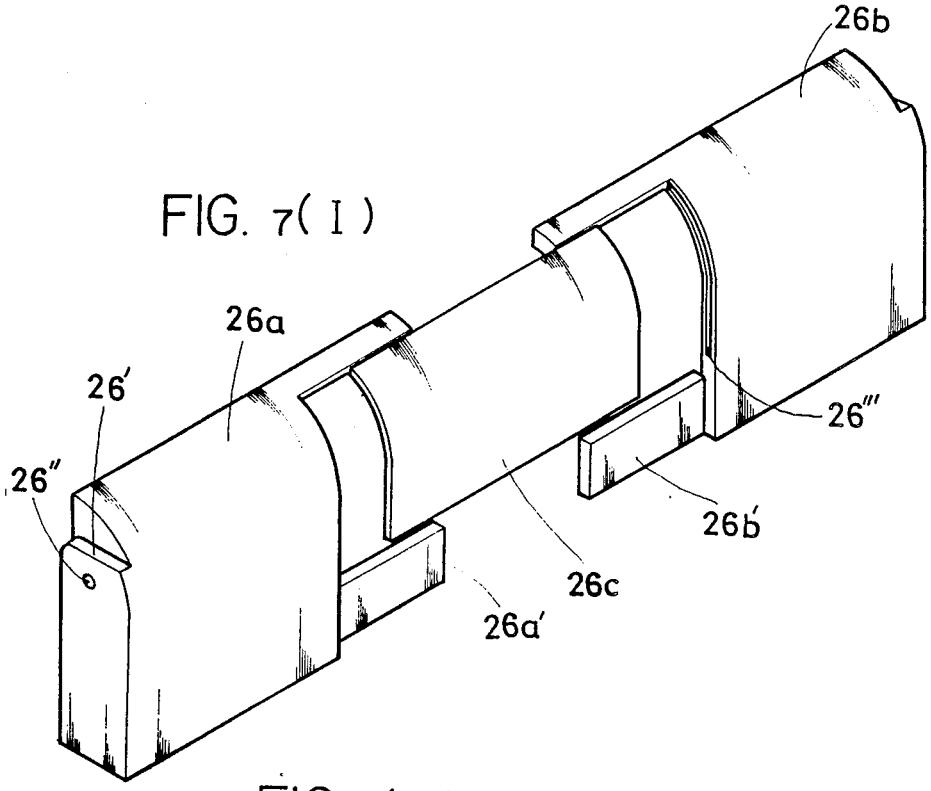
Figure 7:
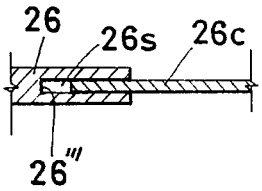
Figure 7:
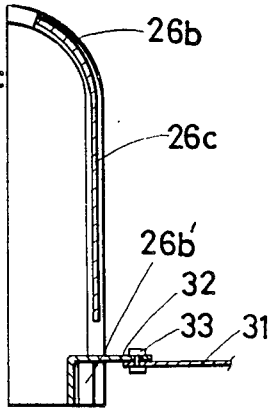

The reinforcing member 26 has a shape as shown in FIG. 7 (I). FIG. 7 (I) also shows that the opposite tips of the reinforcing member 26 is provided with a stepped end 26' respectively, in which a hinge pin hole 26'' is formed in the outer face of the stepped end 26'. The reinforcing member 26 is composed of two members 26*a*, 26*b* which are opposedly located, with a slit 26''' and a large slot being provided in each of the members 26*a*, 26*c* so that a reinforcing plate 26*c* could be installed between the members 26*a*, 26*b*. That is, the reinforcing plate 26*c* which is gently curved is inserted into each of the said slits 26'' which are also curved, and the curved slits are respectively provided with an extra depth which remains as a hollow space after the reinforcing plate 26*c* is inserted into the curved slits, the said extra depth being a measure against thermal deformations. The extra depth of the slit is shown in FIG. 7 (II). As shown in FIG. 7 (III) and (IV), the range table 5 which is to be described further below is mounted on a support plate 32, and this support plate 32 can be installed within the space formed between the reinforcing plate 26*c* and the projected ends 26*a'*, 26*b'*.

Figure 8:
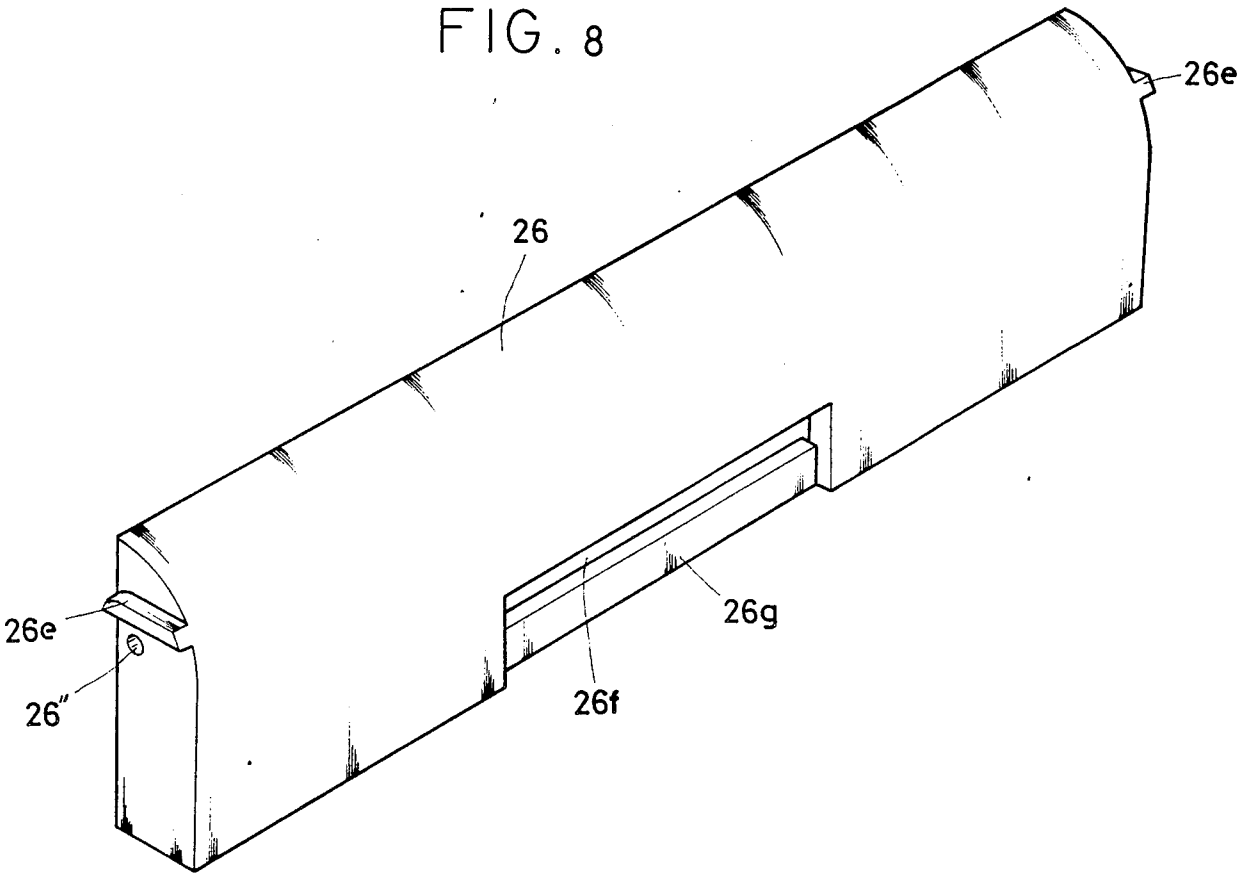
FIG. 8 shows another embodiment in which the reinforcing member of FIG. 7 is given a variation.

FIG. 8 shows another embodiment of the reinforcing member 26 which is substantially the same as that shown in FIG. 7 (I), except that the reinforcing member is composed of a single piece. Here the reinforcing member 26 is provided at its opposite ends a hinge pin hole 26" and a projection 26*e* so as for them to be pressingly contacted with the projected end 23' of the cooking table 3, while the middle portion of the reinforcing member 26 is provided with a long slit 26*f* and a slit edge portion integrally thereto, so that the support plate 32 for the range table 5 could be inserted.

Links 27 are installed inwardly foldably between the frame 15 and the legs 16,17 respectively, and under the left side of the cooking table 3, there are installed a support plate 28 and a securing bar 28' between the legs 16.

A grill 4 in the form of a network is secured to the legs 16 at its one side, while its other side is secured to the lower tip of a depending rod 29 which is depending from the frame 15. When the foldable sink table is folded up, the range table serves as the lower cover, while, if the foldable sink table is fully unfolded, the range table is used for mounting a heating means such as gas range or stove. As shown in FIGS. 1 and 7 (III) and (IV), a plate 31 as the table plate is secured on its three sides by means of an outer frame 30, while the remaining one side is open. But the middle portion of this open side of the plate 31 is secured to the rectangularly bent support plate 32 by means of a rivet 33 as shown in FIGS. 7 (III) and (IV).

Thus the rectangularly bent support plate 32 is inserted into the gap between the reinforcing plate 26*c* and the projected ends 26*a*' and 26*b*'. When the range table 5 is folded up, the plate 31 is positioned parallel with the reinforcing member 26 as shown in FIG. 7 (III), while if the range table 5 is unfolded, the plate 31 is positioned perpendicularly to the reinforcing member 26 as shown in FIG. 7 (IV), so that, in the latter case, the rectangularly bent support plate 32 could be supported by being mounted upon the projected ends 26*a*', 26*b*'.

Further one end of the frame 30 is secured pivotally to the leg 17, while an intermediate position of the same frame 30 is pivotally secured to the upper end of a depending rod 33, the other end of the depending rod 33 being pivotally secured to a frame 34 of the multi-purpose shelf 6.

The said multi-purpose shelf 6 is disposed below the above described range table 5, while, as shown in FIG. 1(B), a plate 35 is inserted into a channel 34' formed along the frame 34, and is secured fixedly by a rivet. Meanwhile, as shown in FIG. 1, the frame 34 is secured pivotally to the ends of the legs 36 and to the ends of the depending rod 33, while a link 38 is connected foldably to the opposite sides of the frame 34 and to the securing bar 37 installed between the legs 17. That is, the links 38 are respectively installed between the frame 34 and the securing bar 37. Further, links 40 are respectively foldably installed between a securing bar 39 of the leg 36 and the frame 34. The intermediate positions of the links 38,40 are provided with a hinge pin respectively, so that they could be folded.

Reference No. 43 indicates a cap for putting to the ends of legs and frames, reference No. 44 indicates a locking ring for locking the front frame of the cooking table 3 to the upper cover when the foldable sink table is folded up, and reference No. 45 indicates a locking ring for locking the range table when the range table is folded up.

Now the present invention thus constituted will be described as to its functions and effects.

Figure 9:
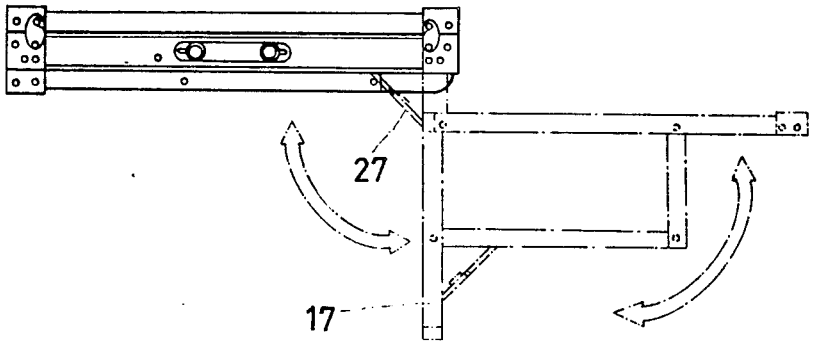
FIGS. 9 (I–V) show the process by which the foldable sink table of the present invention is folded up.
Figure 9V:
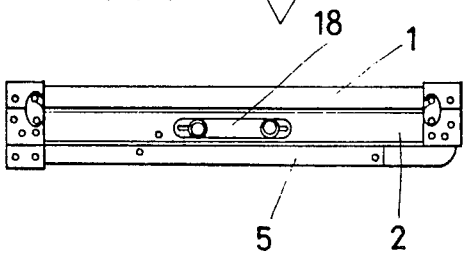

The fully unfolded state of the foldable sink table according to the present invention is as shown in FIG. 1, and the procedure of folding the same table will be described referring to FIGS. 9 (I–V). As shown in FIG. 9 (I) and (II), first the upper cover 1 is folded by manipulating the links 11, and then the cover 1 is locked up by means of the locking rings 44. Then as shown in FIG. 9 (III), the links 27 and the grill 4 are folded to fold the legs 16, and the links 42 are folded to fold the legs 36. Further as shown in FIG. 9 (IV), the range table 5 together with the links 38 and the multi-purpose shelf 6 are folded, and at the same time the legs 17 are folded by manipulating the right side links 27. Then if the locking rings 45 are locked up, the foldable sink table as shown in FIG. 1 is reduced into a compact portable shape as shown in FIG. 9 (V).

The above described folding sequence does not have to be necessarily observed, but the user can fold according to his (her) own convenient method. Meanwhile, the unfolding of the sink table can be carried out by applying inversely the folding procedure described above.

Figure 10:
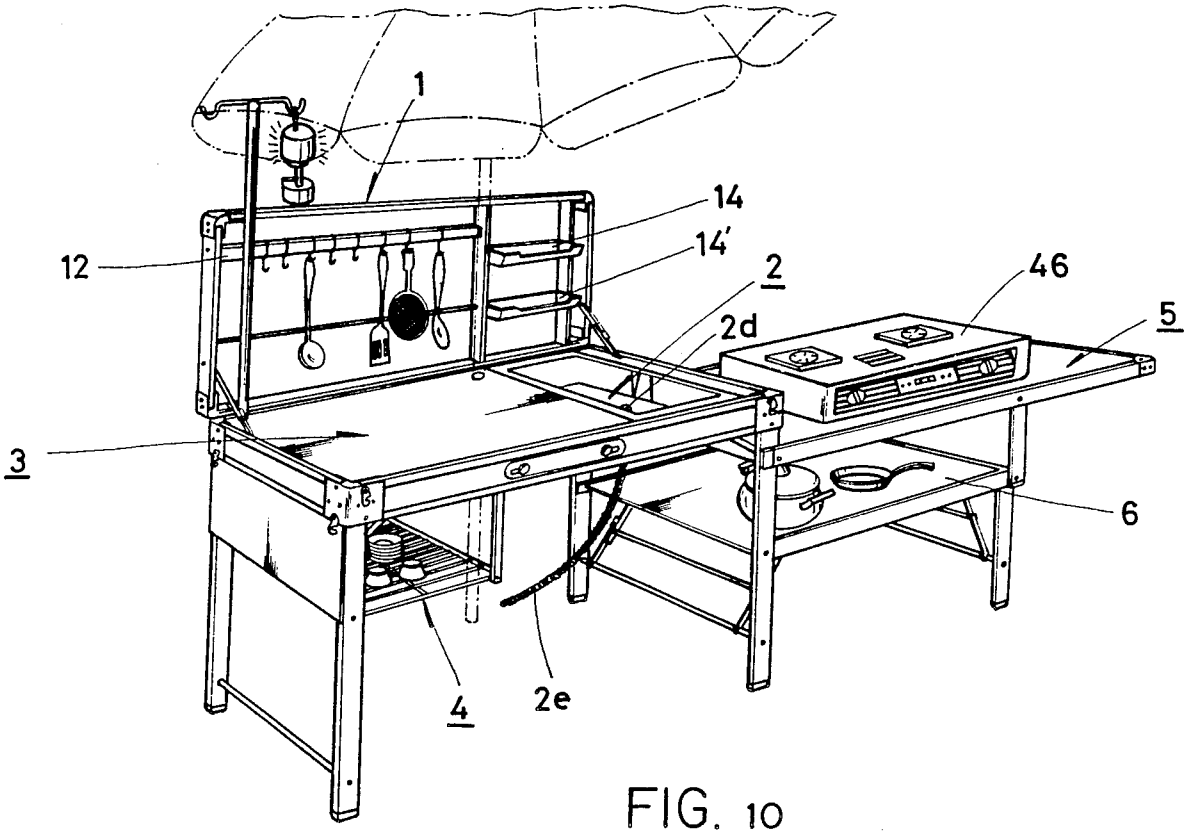
FIG. 10 shows in a perspective view the usable state of the foldable sink table according to the present invention.

FIG. 10 is an examplary view of a using state of the foldable sink table according to the present invention. Various cooking aids are hung on the hanging rod of the upper cover 1, and the rubber string 13 installed below sustains the said cooking aids hung above so that they should not be oscillated by external factors such as wind and the like. Small condiment bottles and spice bottles can be mounted upon the small shelves 14, 14', and the sink basin 2 is provided with a drain hole and a drain hose 2*e*, thereby making it possible to drain away the water in the sink basin to outside through the hose by removing the closure 2*d* after carrying out the dishwashing. The washed dishes can be mounted on the grill 4 so as for the dishes to be dried in a natural condition, while the cooking table 3 is used for preparing the materials for foods.

The range table 5 is for mounting the heating means such as a gas range or a stove or a burner to cook foods, while the multi-purpose shelf locating below can receive cooking tools or dishes, or can be used for other purposes.

The method for use of the foldable sink table as described above is but an example, and the foldable sink table can be differently used according to the taste or need of the user.

The foldable sink table according to the present invention is for use in leisure activities such as fishing, camping and the like. If the foldable sink table of the present invention is fully unfolded, it provides a maximum usable area in the form of a cooking table, a sink basin, a grill, a range table, a multipurpose shelf and the like. If the foldable sink table is folded up, it occupies a minimum volume, even in the case where a series of suspension securing or link securing are adopted. Further, as the foldable sink table is made of aluminum, plastic or wood, it is of light weight, has superior strength, is convenient to carry with, and does not give an apprehension for occurrence of a disorder.

Especially, as various modifications can be given to the sink basin, the user can choose one from among the various forms according to the user's taste or need. Meanwhile the unique design of the reinforcing member 26 gives an adequate supporting strength to the overall structure, and particularly to the legs and to the range table.

The overall structure of the present invention can be given various changes and modifications, but it should be understood that all such modifications and changes come within the scope of the present invention, as long as such modifications and changes do not depart from the spirit and technical conception of the present invention.

What is claimed is:

1. A foldable sink table, comprising:

a cover which includes a cover plate with peripheral edges and a cover frame which extends about said peripheral edges and is attached to said peripheral edges;

a cooking table assembly which includes an upper plate having peripheral edges, an upper surface and a lower surface, said cooking table assembly including support means for supporting a sink basin, said support means being in contact with one of said peripheral edges of said upper plate, said cooking table assembly further including a table frame surrounding said upper plate and said support means, and said table frame being attached to said upper plate and said support means;

a sink basin supported by said support means;

hinge means for pivotably connecting said cover frame to said table frame such that said cover frame can pivot from a first position wherein said frames are essentially coplanar to a second position wherein said frames are in an essentially transverse relationship, and said hinge means including locking means for releasably locking said cover frame in said second position;

a plurality of legs secured to said table frame and adapted to pivot from a first leg position essentially coplanar with the lower surface of said upper plate to a second leg position wherein said legs extend away from and below the lower surface of said upper plate;

leg locking means for releasably locking said legs in said second position;

a range table which includes a range plate with peripheral edges and a range frame attached to said peripheral edges, said range frame being pivotably secured to a first pair of said legs, said range frame being adapted to assume a first position wherein said range frame is in contact with said table frame and said range plate is essentially parallel with said upper plate, and said range frame being adapted to rotate about said first pair of legs from said first position to a second position wherein said range frame extends away from said table frame in a manner which places said range plate in an essentially parallel relationship with said upper plate; and retaining means for releasably retaining said range frame in said second position.

2. A foldable sink table as recited in claim 1, further comprising a pair of depending rods each having a first end pivotably attached to said table frame, said foldable sink table also comprising a grill pivotably attached to a second pair of said legs and to the other end of said pair of depending rods, said pair of depending rods adapted to assume a first position, when said second pair of legs is in said first leg position, wherein said depending rods extend essentially parallel with the lower surface of said upper plate, said pair of depending rods also adapted to assume a second position when said legs are in said second leg position, with said depending rods extending parallel to said legs, and said grill being positioned below and essentially in a parallel relationship with said upper plate when said depending rods are in said second position.

3. A foldable sink as recited in claim 1, further comprising a handle, said handle including a flexible strap and two securement members, said flexible strap including two elongated recesses, said securement members being attached to said table frame with each securement member extending through a respective one of said two elongated recesses so as to fix said strap to said table frame, said securement members being positioned with respect to said elongated recesses such that said strap is free to assume a first position wherein said strap is coplanar with said table frame as well as a second position wherein said strap is curved out away from said table frame.

4. A foldable sink as recited in claim 1, wherein said cover frame extends off of said cover plate so as to define a recessed area, said foldable sink further comprising a hanging rod positioned within said recessed area and attached to said cover, and said foldable sink further comprising an elastic string extending parallel to said hanging rod and attached to said cover within said recessed area.

5. A foldable sink as recited in claim 1, wherein said cover frame extends off of said cover plate so as to define a recessed area and at least one shelf is positioned within said recessed area and secured to said cover, said at least one shelf also being positioned such that, when said cover frame is in said first position, said at least one shelf extends into a cavity defined by said sink basin.

6. A foldable sink table as recited in claim 1, wherein there is a first pair of said legs and a second pair of said legs with said first pair of legs having a reinforcing member attached to each leg of said first pair, said reinforcing member being pivotably connected to said table frame and having an abutment shoulder upon which a ridge formed in said table frame is supported when said first pair of legs is in said second leg position.

7. A foldable sink table as recited in claim 6, wherein said range table includes an angled bracket attached to one edge of said range plate, and said reinforcing member is a unitary body with an elongated slit formed therein which extends along a portion of the length of said reinforcing member, and said slit being dimensioned so as to receive said angled bracket and said slit being defined in part by a slit edge member which supports said angled bracket and attached range plate.

8. A foldable sink as recited in claim 6, wherein said range table includes an angled bracket attached to one edge of said range plate and said reinforcing member is comprised of two end members each having a recessed slot, a slit formed therein and projected extensions, said reinforcing member further including a reinforcing plate which is slidably lockable within said recessed slot and slit such that a clearance is provided above said projected extensions which is dimensioned to receive said angled bracket such that said angled bracket is supported by said projected extensions.

9. A foldable sink table as recited in claim 1, further comprising a multi-purpose shelf assembly having a shelf plate with peripheral edges and a shelf frame with a channel formed therein for receiving said shelf plate peripheral edges, said multi-purpose shelf assembly further comprising a pair of linkage assemblies, a first one of said linkage assemblies being pivotably secured to a first pair of said legs and also to said shelf frame, and said retaining means comprising a pair of depending members each having a first end pivotably connected to said range frame and each having a second end pivotably connected to said shelf frame, said retaining means further comprising a pair of stub legs each pivotably attached at one end to said shelf frame, and a second of said pair of linkage assemblies being pivotably connected to said stub legs and to said shelf frame.

10. A folding sink table as recited in claim 1, further comprising latching means for latching said cover frame to said table frame when said cover frame is in said first position.

11. A folding sink table as recited in claim 1, further comprising hooking means for hooking said range frame to said table frame when said range frame is in said first position.

12. A foldable sink table as recited in claim 1, wherein said sink basin has a projected upper edge with said projected upper edge having an under surface adapted for contact with said sink basin support means, said sink basin further including side walls which have sloped recesses formed therein to facilitate positioning of said sink basin with respect to said sink basin support means.

13. A foldable sink table as recited in claim 12, wherein said sink basin has an extended drain member defining a drain hole in said sink basin, said sink basin further comprising an insert positioned within said drain hole and in contact with said extended drain member, and said sink basin further comprising a closure cap threadably received by said insert.

14. A foldable sink table as recited in claim 13, wherein said extended drain member includes an angled recess and said sink basin further includes a hose connector which includes a protrusion frictionally retained in said angled recess and a nozzle with a plurality of projections formed on the exterior of said nozzle for enhancing friction contact with a drain hose.

15. A foldable sink table as recited in claim 1, wherein said sink basin has a projected upper edge with an under surface adapted for supporting contact with said sink basin support means, and said sink basin having side walls of a horizontal furrow type which enable compression and extension of said side walls, and said sink basin further comprising a plurality of adjustable straps which are adapted to support said side walls and to allow for variations in the degree of extension of said furrow shaped side walls.

16. A foldable sink table comprising:

a sink basin;

a cooking table assembly which includes an upper plate having peripheral edges and an upper and lower surface, said cooking table assembly including support means for supporting said sink basin such that said sink basin is adjacent one of the peripheral edges of said upper plate, said cooking table assembly further including a table frame surrounding said upper plate and said support means, and said table frame being attached to said upper plate and said support means;

a plurality of legs secured to said table frame and adapted to pivot from a first leg position essentially coplanar with the lower surface of said upper plate to a second leg position wherein said legs extend away from and below the lower surface of said upper plate;

depending rods each having a first end pivotably attached to said table frame;

a grill pivotably attached to a first pair of said legs and to the other end of said pair of depending rods, said grill being positioned below and essentially in a parallel relationship with the lower surface of said upper plate when said pair of legs is in said second leg position;

a range table which includes a range plate with peripheral edges and a range frame attached to said peripheral edges, said range frame being pivotably secured to a second pair of said legs, said range frame being adapted to assume a first position wherein said range frame is in contact with said table frame and said range plate is essentially parallel with said upper plate, and said range frame also adapted to rotate about 180° with respect to said second pair of legs to assume a second position wherein said range frame extends away from said table frame in a manner which places said range plate in an essentially parallel relationship with said upper plate.

17. A foldable sink table as recited in claim 16, wherein said second pair of legs includes a reinforcing member attached to each leg of said second pair, said reinforcing member being pivotably connected to said table frame and having an abutment shoulder upon which a ridge formed in said table frame is supported when said second pair of legs is in said second leg position.

18. A foldable sink table as recited in claim 17, wherein said range table includes an angled bracket and said reinforcing member includes a slot for receiving said angled bracket in supportive fashion.

19. A foldable sink table as recited in claim 16, further comprising a multi-purpose shelf assembly having a shelf plate with peripheral edges and a shelf frame attached to said peripheral edges, said multi-purpose shelf assembly including a pair of linkage assemblies, a first one of said linkage assemblies being pivotably secured to said second pair of legs and to said shelf frame, and said folding sink table further comprising retaining means for retaining said range table in said second position with said retaining means comprising a pair of depending members each having a first end pivotably connected to said range frame and each having a second end pivotably connected to said shelf frame, said retaining means further comprising a pair of stub legs each pivotably attached at one end to said shelf frame, and a second of said pair of linkage assemblies being pivotably connected to said stub legs and to said shelf frame.

20. A foldable sink table, comprising:

a cover which includes a cover plate with peripheral edges and a cover frame which extends about said peripheral edges and is attached to said peripheral edges;

a cooking table assembly which includes an upper plate having peripheral edges, an upper surface and a lower surface, said cooking table assembly including support means for supporting a sink basin, said support means being in contact with one of said peripheral edges of said upper plate, said cooking table assembly further including a table frame surrounding said upper plate and said support means, and said table frame being attached to said upper plate and said support means;

a sink basin supported by said support means;

hinge means for pivotably connecting said cover frame to said table frame such that said cover frame can pivot from a first position wherein said frames are essentially coplanar to a second position wherein said frames are in an essentially transverse relationship, and said hinge means including locking means for releasably locking said cover frame in said second position;

a plurality of legs secured to said table frame and adapted to pivot from a first leg position essentially coplanar with the lower surface of said upper plate to a second leg position wherein said legs extend away from and below the lower surface of said upper plate;

leg locking means for releasably locking said legs in said second position; and said cover frame extending off of said cover plate so as to define a recessed area, and at least one shelf is positioned within said recessed area and secured to said upper cover, and said at least one shelf being positioned such that, when said cover frame is in said first position, said at least one shelf extends into a cavity defined by said sink basin.

21. A foldable sink table as recited in claim 20, further comprising a pair of depending rods each having a first end pivotably attached to said table frame, said foldable sink table also comprising a grill pivotably attached to a first pair of said legs and to the other end of said pair of depending rods, said pair of depending rods adapted to, when said second pair of legs is in said first leg position, to assume a first position, wherein said depending rods extend essentially parallel with the lower surface of said upper plate, said pair of depending rods also adapted to assume a second position with said depending rods extending parallel to said legs when said legs are in said second leg position, and said grill being positioned below and essentially in a parallel relationship with said upper plate when said depending rods are in said second position.

22. A foldable sink as recited in claim 20, further comprising a hanging rod positioned within said recessed area and attached to said cover, and an elastic string extending parallel to said hanging rod and attached to said cover within said recessed area.

* * * * *